United States Patent [19]

Zuffi

[11] Patent Number: 4,986,224

[45] Date of Patent: Jan. 22, 1991

[54] FOUR CYCLE DIESEL ENGINE WITH PRESSURIZED AIR COOLING SYSTEM

[76] Inventor: Natalio J. Zuffi, 2G River Run, New Hartford, Conn. 06057

[21] Appl. No.: 534,474

[22] Filed: Jun. 7, 1990

Related U.S. Application Data

[63] Continuation-in-part of Ser. No. 309,432, Feb. 13, 1989, abandoned.

[51] Int. Cl.[5] ..... F01P 1/00

[52] U.S. Cl. ..... 123/41.56; 123/76; 123/433

[58] Field of Search ..... 123/41.56, 65 BA, 65 VD, 123/433, 528, 559.1, 565, 65 VB, 76, 84, 316

[56] References Cited

U.S. PATENT DOCUMENTS

| | | | |
|---|---|---|---|
| 4,386,587 | 6/1983 | Simko | 123/65 VD |
| 4,660,513 | 4/1987 | Figliuzzi | 123/65 VD |

FOREIGN PATENT DOCUMENTS

| | | | |
|---|---|---|---|
| 13180 | 7/1980 | European Pat. Off. | 123/65 BA |
| 1014384 | 8/1952 | Fed. Rep. of Germany | 123/433 |
| 111151 | 4/1947 | Netherlands | 123/433 |

*Primary Examiner*—Noah P. Kamen
*Attorney, Agent, or Firm*—Robert S. Smith

[57] ABSTRACT

An internal combustion engine apparatus includes a cylinder having a head, an intake valve cooperating with the head for selectively allowing passage of fluids into the cylinder and an exhaust valve for selectively allowing passage of fluids out of the cylinder. The exhaust and inlet valves are open during both the intake and exhaust phases of operation of the engine. A piston is mounted for reciprocal movement in the cylinder between a top dead center position and a bottom dead center position. The cylinder has at least one opening therein, the opening is disposed in a side wall thereof intermediate the top dead center position and the bottom dead center position. The opening communicates between the interior of the cylinder and space outside of the cylinder and the opening is fully covered by the piston in at least one position of the piston. The engine also includes apparatus for pressurizing air and apparatus for fluid coupling the apparatus for pressurizing air to the opening and to the intake valve simultaneously during both intake and exhaust phases of the engine.

8 Claims, 2 Drawing Sheets

FOUR CYCLE DIESEL ENGINE WITH PRESSURIZED AIR COOLING SYSTEM

RELATED APPLICATIONS

This application is a continuation in part of U.S. patent application Ser. No. 07/309,432 filed Feb. 13, 1989, now abandoned.

BACKGROUND OF THE INVENTION

The invention has particular application to four stroke supercharged diesel engines and specifically a particular construction of such engines to maximize engine cooling. It will be understood that the invention also has application to use with conventional internal combustion engines as well as diesel and conventional engines which are provided with a turbocharger particularly if the gasoline engine has direct cylinder injection of the gasoline.

The prior art includes various apparatus which have utilized the air flow from a turbocharger or a supercharger for engine cooling. The prior art includes the following U.S. Pat. Nos.: Gettinger 2,209,078; Townsend 4,129,101; Katayama 4,573,808; Townsend 4,127,096; Okano et al 4,376,617; and Johnson 4,656,975.

U.S. Pat. No. 4,376,617 shows the use of air from the compressor section of a turbocharger being directed to an annular air passage to cool parts of the turbocharger. U.S. Pat. No. 4,573,808 describes a pneumatic journal member which has compressed air introduced into the clearance space between the journal member and a cylindrical bearing surface.

The journal member is formed with holes to admit compressed air into an interior space to cool the shaft. The patent suggests that the compressed air is supplied by the compressor section of the turbocharger.

U.S. Pat. No. 4,656,975 describes the use of low pressure air from an engine supercharger which is guided by a passage across external surfaces of the engine cylinders for cooling.

It is an object of the invention to provide apparatus having particular application to diesel engines which will eliminate the necessity for liquid cooling.

It is another object of the invention to provide apparatus which will substantially improve the cooling of internal combustion engines.

It is another object of the invention to provide an internal combustion engine that will have relatively cool exhaust gasses as compared to other internal convention combustion engines and particularly diesel engines.

Still another object of the invention is to provide a diesel engine that will have a progressive combustion step to obtain greater power for a given amount of fuel.

SUMMARY OF THE INVENTION

It has now been found that these and other objects of the invention may be attained in an internal combustion engine which includes a a cylinder having a head, an intake valve cooperating with the head for selectively allowing passage of fluids into the cylinder and an exhaust valve for selectively allowing passage of fluids out of the cylinder. The exhaust and inlet valves are open during both the intake and exhaust phases of operation of the engine. A piston is mounted for reciprocal movement in the cylinder between a top dead center position and a bottom dead center position. The cylinder has at least one opening therein disposed in a side wall thereof intermediate the top dead center position and the bottom dead center position. The opening communicates between the interior of the cylinder and space outside of the cylinder. The opening is fully covered by the piston in at least one position of the piston. The apparatus also includes means for pressurizing air and means for fluid coupling the means for pressurizing air to the opening and to the intake valve simultaneously during both intake and exhaust phases of the engine. The means for pressurizing air may be a supercharger and the engine may be a four stroke diesel engine. In some forms of the invention the cylinder includes a plurality of additional openings therein communicating between the interior thereof and the means for fluid coupling the means for pressurizing air to the opening. The openings are all disposed at substantially one axial portion of the cylinder in some forms of the invention. The means for fluid coupling may comprise an annular housing surrounding at least an axial portion of the cylinder. Each of the openings may have substantially the same height. The engine may include an intake manifold and the supercharger may also be connected to the intake manifold of the engine.

BRIEF DESCRIPTION OF THE DRAWING

The invention will be better understood by reference to the accompanying drawing in which.

DESCRIPTION OF THE PREFERRED EMBODIMENT

Figures 1, 2, 3, 4:
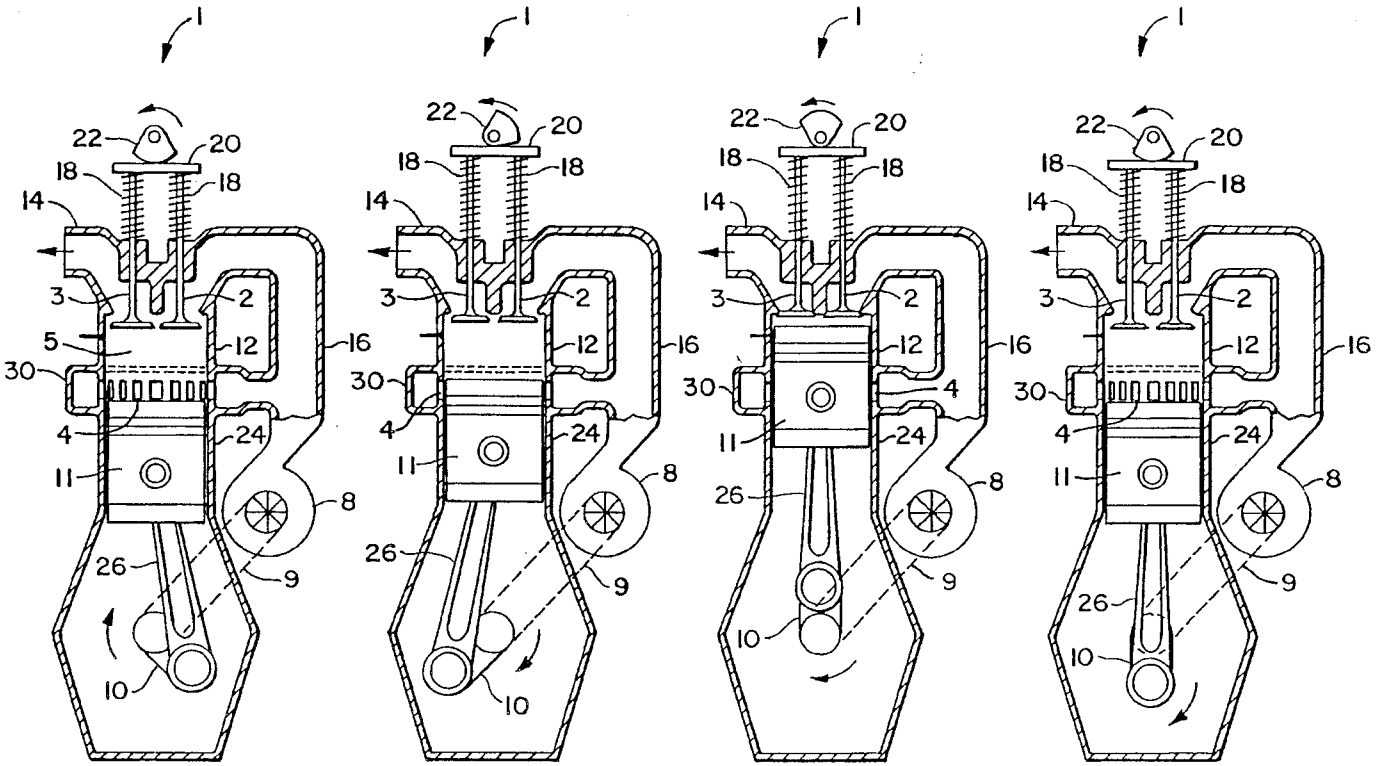
FIG. 1 is a partially schematic cross sectional elevational view of an engine in accordance with the present invention during the intake phase of operation.
FIG. 2 is a partially schematic cross sectional elevational view of an engine in accordance with the present invention during the compression operation.
FIG. 3 is a partially schematic cross sectional elevational view of engine in accordance with the present invention during the expansion phase of operation.
FIG. 4 is a partially schematic cross sectional elevational view of an engine in accordance with the present invention during the exhaust phase of operation.

Referring now to FIGS. 1–5 there is shown a diesel engine in accordance with one form of the invention. The illustrated engine has only a single cylinder although it will be understood by those skilled in the art that additional may be provided in other embodiments. Those skilled in the art will understand the teachings herein may be applied to a multi-cylinder diesel or gasoline engine. The apparatus includes an engine 1 including a piston 11 which moves reciprocally in a cylinder 24 which is part of an engine block. The piston 11 is coupled in the conventional manner to a connecting rod 26. The connecting rod 26 is coupled in the conventional manner to a crank shaft 10 coupled to the crank shaft 10 is a shaft 9 (shown schematically) and is a supercharger 8. The supercharger in the conventional manner has a scroll which ducts compressed ambient air to the intake manifold 16 of the engine in addition to an annular housing 30 disposed in concentric relationship to the cylinder 12. The cylinder 12 is provided with a plurality of elongated slots 4 as best seen in FIGS. 1 and 4.

In some embodiments, the cylinder 12 and the annular housing 30 may be intergrally formed. The engine also includes an exhaust manifold 14 and a conventional exhaust valve 3 and a conventional inlet valve 2. The valves 2,3 are operated by springs 18,18 and a cam follower 20 and a cam 22.

Figure 5:
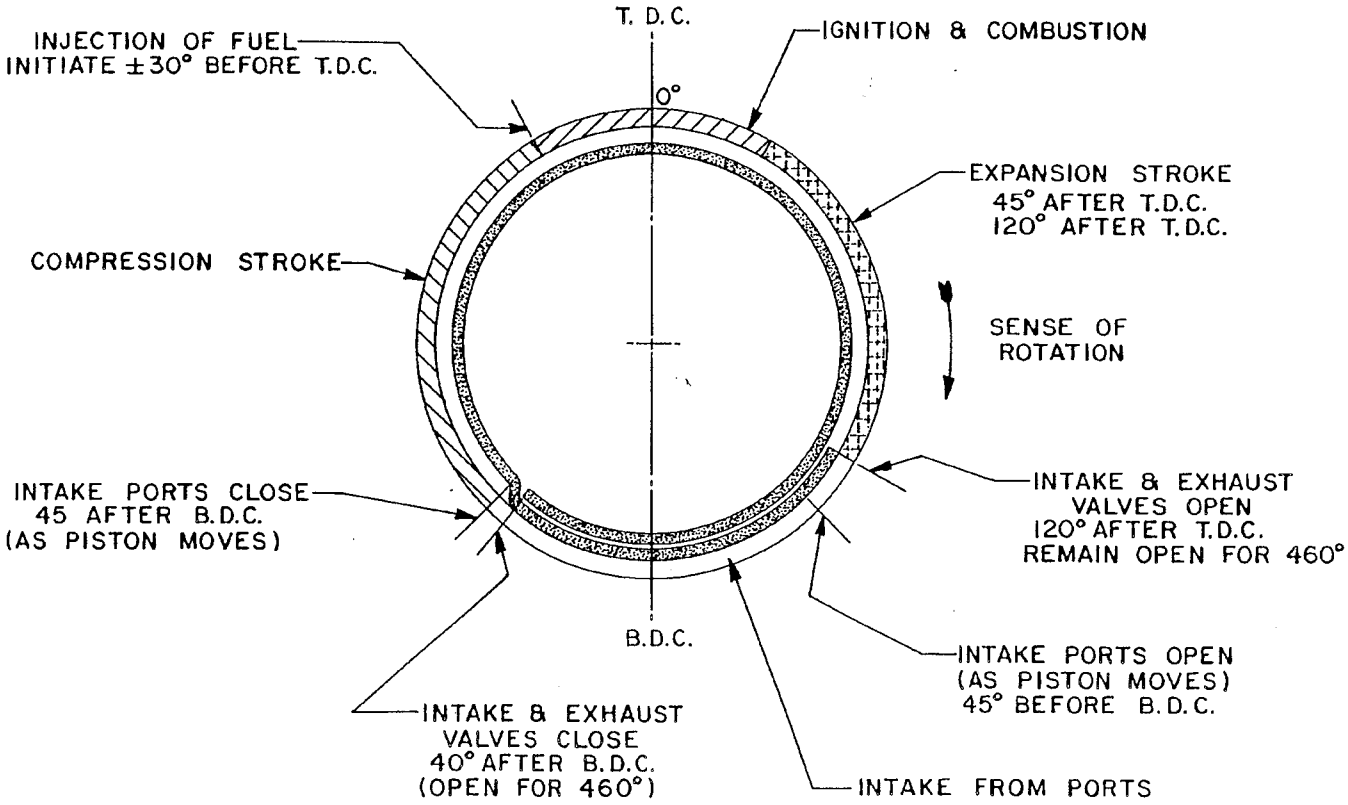
FIG. 5 is a schematic view illustrating the valve timing in a preferred form of the invention.

After the intake phase of operation illustrated in FIG. 1, both the intake valve 2 and the exhaust valve 3 are open and air flows from the supercharger 8 into the intake manifold 16, through the intake valve 2 and thence through the space 5 within the cylinder 12. The air then passes through the exhaust valve 3 and out the exhaust mainfold 14. Concurrently, air passes from the supercharger 8 into an annular housing 30 which surrounds a portion of the cylinder head 12 that includes a plurality of elongated slots 4. In other words, some air from the supercharger is ducted to the annular housing 30 which directs it into the openings 4 and thence into the space 5 within the cylinder 12 so that this air will also pass out the exhaust valve 3 and thence out the exhaust manifold 14. It will be seen that the flow of relatively cool air from the supercharger 8 into the cylinder through both the intake valve 2 and the opening 4 by substantial cooling to the intake valve as well as the cylinder 12 and piston 11. It will be also apparent that fresh oxygen rich air will also be forced into the space 5 in this manner. A more detailed description of valve timing in a preferred embodiment of the invention is shown in FIG. 5.

Referring now to FIG. 2 there is shown the compression phase of operation in which the piston 11 moves upward from the position shown in FIG. 1. It will be seen that in the conventional manner the intake valve 2 and the exhaust valve 3 will close during this phase and the opening 4 will be disposed below the top of the piston 11 and thus there is no fluid communication between the supercharger 8 and the space 5 within the cylinder 12. As in the conventional diesel engine, combustion will occur when the compressed air within the space 5 reaches a temperature which is high enough to cause auto ignition of fuel which has been injected into the space 5. In the present invention, the fuel injection apparatus will preferably have a cam arrangement which will provide a longer period of fuel injection than in conventional diesel engines. This is particularly advantageous so that the combustion is more progressive. Advantageously, the pressure will be higher than conventional engines and ignition will occur at approximately ⅓ of the stroke after the bottom dead center position has passed.

Referring now to FIG. 3 there is shown the start of the expansion stroke during which the piston 11 moves down until is reaches a point only slightly covering the openings or ports 4 and the intake valve 2 and exhaust valve will then start to open. A strong flow of air from the supercharger 8 is thus introduced in the cylinder 12 and particularly the space 5. As the ports 4 are uncovered a very strong flow of air from supercharger 8 cools the walls of the cylinder 12.

Referring now to FIG. 4 there is shown the exhaust phase of operation during which the piston 11 is again moving upwardly and pushing air out of the cylinder 12 and out the exhaust valve 3 to the exhaust manifold 14. Air flow passes from the supercharger into the intake valve 2 and to the openings or ports 4 to further cool the cylinder 12.

It will be understood by those skilled in the art that the compression ratio in the present apparatus can be lower then in other known apparatus and thus the engine including the pistons does not have to be as heavy and in engines which are conventionally used.

The invention has been described with reference to its illustrated preferred embodiment. Persons skilled in the art of internal combustion engine design may upon exposure to the teaching herein, conceive other variations. Such variations are deemed to be encompassed by the disclosure, the invention being delimited only by the appended claims.

Having thus described my invention I claim:

1. An internal combustion engine apparatus which comprises:

a cylinder having a head;

an intake valve cooperating with said head for selectively allowing passage of fluids into said cylinder and an exhaust valve for selectively allowing passage of fluids out of said cylinder means for opening said exhaust and inlet valves together during both said intake and exhaust phases of operation of said engine;

a piston mounted for reciprocal movement in said cylinder between a top dead center position and a bottom dead center position;

said cylinder having at least one opening therein, said opening being disposed in a side wall thereof intermediate said top dead center position and said bottom dead center position, said opening communicating between the interior of said cylinder and space outside of said cylinder, said opening being fully covered by said piston in at least one position of said piston; and means for pressurizing air; and means for fluid coupling said means for pressurizing air to said opening and to said intake valve simultaneously during both intake and exhaust phases of said engine.

2. The apparatus as described in claim 1 wherein:

said means for pressurizing air is a supercharger.

3. The apparatus as described in claim 2 wherein:

said engine is a four stroke diesel engine.

4. The apparatus as described in claim 3 wherein:

said cylinder includes a plurality of additional openings therein communicating between the interior thereof and said means for fluid coupling, said means for pressurizing air to said opening.

5. The apparatus as described in claim 4 wherein:

said openings all being disposed at substantially one axial portion of said cylinder.

6. The apparatus as described in claim 5 wherein:

said means for fluid coupling comprises an annular housing surrounding at least an axial portion of said cylinder.

7. The apparatus as described in claim 6 wherein:

each of said openings has substantially the same height.

8. The apparatus as described in claim 7 wherein:

said engine includes an intake manifold and said supercharger is also connected to the intake manifold of said engine.

* * * * *